US007310918B1

(12) United States Patent
Reuter et al.

(10) Patent No.: US 7,310,918 B1
(45) Date of Patent: Dec. 25, 2007

(54) HYBRID OFFICE PANEL CONSTRUCTION FOR A MODULAR OFFICE FURNITURE SYSTEM

(75) Inventors: Robert E. Reuter, Suffolk County, NY (US); Charles P. Rozier, Jr., New York County, NY (US); Wallace C. Bullwinkle, Montgomery County, PA (US)

(73) Assignee: Knoll, Inc., East Greenville, PA (US)

( * ) Notice: Subject to any disclaimer, the term of this patent is extended or adjusted under 35 U.S.C. 154(b) by 654 days.

(21) Appl. No.: 09/636,359

(22) Filed: Aug. 11, 2000

Related U.S. Application Data

(63) Continuation of application No. 08/864,138, filed on May 28, 1997, now Pat. No. 6,167,664.

(51) Int. Cl.
*E04C 2/52* (2006.01)

(52) U.S. Cl. ..... 52/220.7; 52/239; 52/243.1; 52/220.2; 52/36.5; 52/481.2

(58) Field of Classification Search ..... 52/220.7, 52/236.9, 238.1, 239, 241–242, 243.1, 220.2, 52/36.1, 36.5, 481.1, 481.2, 489.1, 483.1, 52/474, 476, 781.3, 770, 259; 160/351, 135
See application file for complete search history.

(56) References Cited

U.S. PATENT DOCUMENTS 3,697,034 A * 10/1972 Shell ..... 248/243
3,858,988 A * 1/1975 Cohen ..... 403/18
3,871,153 A 3/1975 Birum, Jr.
3,888,440 A * 6/1975 Rebentisch ..... 248/73
4,154,419 A * 5/1979 Breidenbach ..... 248/243
4,382,642 A 5/1983 Burdick
4,391,073 A * 7/1983 Mollenkopf et al. ..... 52/241
4,403,700 A 9/1983 Manlove
4,433,630 A 2/1984 Laborie
4,478,339 A 10/1984 Herr et al.
4,535,577 A * 8/1985 Tenser et al. ..... 174/48
4,546,889 A 10/1985 Schoumaker et al.
4,567,698 A * 2/1986 Morrison ..... 52/36.6
4,619,486 A 10/1986 Hannah et al.
4,625,477 A * 12/1986 Johnstonbaugh ..... 52/127.9
4,631,881 A * 12/1986 Charman ..... 52/481.2
4,685,255 A 8/1987 Kelley
4,821,477 A 4/1989 Rydqvist (Continued)

*Primary Examiner*—Richard E. Chilcot, Jr.
*Assistant Examiner*—Chi Q. Nguyen
(74) *Attorney, Agent, or Firm*—Buchanan Ingersoll & Rooney PC

(57) ABSTRACT

A wall spine assembly for a modular office system comprises a plurality of individual panel assemblies. Each of the panel assemblies includes a vertical support structure and mechanically affixed lower panels in a rigid box-beam structure. Facing panels are removably attached to support brackets mounted on the vertical supports. A cavity exists between the facing panels and vertical supports to permit the lay-in of cabling through the office system. A crown member is provided on the top of the vertical support and is adapted to receive brackets for the mounting of accessories above a desk or other work surface attached to the panel. The panels, and especially the crown, permit the mounting of office components such as shelves, storage cabinets, lighting fixtures and the like anywhere along the horizontal length of the wall. A horizontally telescoping vertical end post is also provided.

14 Claims, 11 Drawing Sheets

U.S. PATENT DOCUMENTS 4,828,120 A 5/1989 Beil et al.
4,876,835 A 10/1989 Kelley et al.
4,883,330 A 11/1989 Armstrong et al.
4,905,428 A 3/1990 Sykes
4,914,873 A 4/1990 Newhouse
4,932,177 A 6/1990 Hinden
4,944,122 A 7/1990 Wendt
5,013,112 A 5/1991 Hellwig
5,024,030 A 6/1991 Morrison
5,038,539 A 8/1991 Kelley et al.
5,056,577 A 10/1991 DeLong et al.
5,086,597 A 2/1992 Kelley et al.
5,092,253 A 3/1992 Grund et al.
5,094,174 A 3/1992 Grund et al.
4,876,835 A 6/1992 Kelly et al.
5,155,955 A 10/1992 Ball et al.
5,163,752 A 11/1992 Copeland et al.
5,172,974 A 12/1992 Riban
5,184,441 A 2/1993 Balfanz, Jr.
5,209,035 A * 5/1993 Hodges et al. ..... 52/220.7
5,209,562 A 5/1993 Glassford
5,214,890 A 6/1993 Levitan et al.
5,228,579 A 7/1993 Kaufman
5,241,796 A 9/1993 Hellwig et al.
5,277,005 A 1/1994 Hellwig et al.
5,277,007 A 1/1994 Hellwig et al.
5,287,666 A 2/1994 Frascaroli et al.
5,309,686 A 5/1994 Underwood et al.
5,341,615 A 8/1994 Hodges et al.
5,383,318 A 1/1995 Kelley et al.
5,400,560 A 3/1995 Hellwig et al.
5,406,760 A 4/1995 Edwards
5,428,928 A 7/1995 Hellwig et al.
5,537,766 A * 7/1996 Nickens et al. ..... 52/71
5,638,650 A 6/1997 Edwards
5,685,113 A 11/1997 Reuter et al.
5,702,175 A 12/1997 Chen
5,802,789 A 9/1998 Goodman et al.
5,899,035 A * 5/1999 Waalkes et al. ..... 52/36.1
6,000,180 A * 12/1999 Goodman et al. ..... 52/239
6,098,358 A * 8/2000 Waalkes et al. ..... 52/36.1
6,260,324 B1 * 7/2001 Miedema et al. ..... 52/481.2

* cited by examiner

HYBRID OFFICE PANEL CONSTRUCTION FOR A MODULAR OFFICE FURNITURE SYSTEM

This application is a continuation of application Ser. No. 08/864,138, filed May 28, 1997 now U.S. Pat. No. 6,167,664.

BACKGROUND OF THE INVENTION

1. Field of the Invention

The present invention relates to wall panels for use in modular open office systems, and more particularly to a multi-functional structural beam arrangement which rigidifies an open framework used to support removable facing panels and modular office components.

2. Description of the Prior Art

The use of modular open office furniture systems has become quite prevalent in interior office design. One aspect of these open office systems is a single free standing wall unit, or spine, which forms the main structural element of the open office system. The main function of the spine assembly is to support a work surface or desktop for a user, and as a means for routing data, communication and power cables through the open office system to provide cabling for the desktop units. In addition to the desktop, other office components such as shelves and overhead light assemblies may be suspended from the spine assembly. Moreover, the spine assembly provides supports for other wall panels and office components within the system that help define the individual work areas.

The spine assembly, or wall partition, provides an interior framework which supports decorative side panels to provide a modern office system. The spine assembly is typically made up of individual panels, which can be attached to each other so as to form a continuous wall, or also include connections such as L-shaped or T-shaped wall panels.

Typically, these panels are of a full size and are supplied as a finished unit. Thus, the accessories which can be mounted to the individual panels that make up the spine assembly are limited to attachments at the ends of each of the wall panels, such as at the connection of one panel to another. Moreover, most conventional office systems are designed within specific dimensions, or modules, requiring conformity of attachment of office accessories within the required module at very specific locations, for example every 6 inches. Additionally, if it is desired to provide an L-shaped connection or a perpendicular wall panel attached to the spine assembly they are also limited to the connection of the panels. This requires an additional spacer for mounting of a perpendicular panel to the spine which can increase the nominal wall length. This generally requires that a perpendicular wall panel have attached on the opposite side thereto another perpendicular panel in a mirror image of the workstation. This may be due to the fact that on the opposite side of a perpendicular attachment, since such attachment must be made at the panel connection, the vertical gap between panels may be visible, thus requiring a separate trim piece. This type of arrangement does not provide for complete freedom in the design of the overall workstation floor plan since the walls are limited in length based upon the dimensions of the individual panels that make up the spine assembly.

Moreover, in order to mount overhead shelves, for example, a higher panel for the spine assembly is required. This is necessitated by the fact that overhead storage, lighting fixtures and other accessory items must be attached to the panel at a height which is above a minimum level over the work desk so as not to interfere with the work space area or with the user.

Another requirement of panel assemblies for the spine is the need to allow for cabling to be routed through the panel so as to distribute power to the individual workstations that make up the office system. It is most desirable that the cabling be able to be routed through the panel even after the integrated office system has been constructed. This will allow for the maximum flexibility of the office system and reconfiguration of the office in order to meet the changing needs of the office environment. This flexibility is desired while maintaining the rigidity of the spine assembly even when the panels have been disassembled to a degree to allow for the redesign and/or installation of cabling.

U.S. Pat. No. 5,406,760 issued to Edwards discloses an upright partition for use in modular office furniture systems which comprises a frame having vertical posts and a plurality of horizontal beams. The beams are attached to both sides of the vertical post, and panels are attached to the horizontal beams such that a cavity is created between the panel and the vertical posts to define a raceway for data communication and power cabling. As disclosed in the patent to Edwards, it is necessary to provide a double sided panel due to the fact that the horizontal beams are attached to both faces of the vertical posts for support. Also supports for accessories are only attachable at the vertical posts.

What is needed then is a panel construction for a spine assembly which permits the attachment of a myriad of accessories to the panel, and also allows for maximum flexibility in the design of the office system. It would be advantageous if such a system permits the routing of cabling through the spine assembly even after the office system has been fully constructed. Such a system would also preferably have the ability to mount accessories anywhere along the wall spine assembly in a non-modular fashion.

SUMMARY OF THE INVENTION

It is therefore an object of the present invention to provide a multi-functional structural spine assembly that supplies a rigid open framework for an office system.

It is a further object of the present invention to provide such an open framework which supports removable facing panels so as to allow for the laying in of wiring after the construction of the office system.

It is yet a further object of the present invention to provide a panel construction for a spine assembly which allows for the mounting of accessories to the panel anywhere along the length of the wall assembly as well as above the work surface area.

It is a still further object of the present invention to provide a spine assembly which permits attachment of perpendicular divider panels anywhere along the wall length.

The present invention provides a wall construction for use in offices where it is desirable to define space, support work surfaces and storage components, attach perpendicular partitions, manage power and data cabling and terminations and allow for ease in work space reconfiguration and redesign. The objects of the invention provide improved capability to satisfy the following functional objectives: it allows for the attachment of partitions, work surfaces, storage components and accessories to the wall without regard for modularity. The panel assembly of the present invention allows for the lay in of wiring anywhere between a structural framework and removable facing panels. The present invention preserves access for laying in wiring without the removal of attached partitions, work surfaces or storage components so as to allow for flexibility and the redesign of an office system. The present invention provides a matrix of mounting locations for power and data termination modules so that they may be positioned anywhere along the work surface in either horizontal or vertical increments. Moreover, the present invention utilizes the space between the structure and the facing panels for various useful purposes in addition to concealing wiring such as recessed receptacles for power and data, and horizontal channels recessed in the panel wall for supporting accessories (slat wall facing panel) anywhere along the horizontal length of the facing panel.

A first embodiment of the present invention includes a panel assembly for a modular office furniture system comprising a rigid frame assembly and a plurality of facing panels. Means are provided for individually mounting each of said plurality of facing panels to the rigid frame assembly whereby a cavity is formed between the rigid frame assembly and each of said plurality of facing panels. A crown member is attached to a top portion of the rigid frame assembly, the crown member adapted to mount and support office furniture accessories.

In a second embodiment of the present invention, a wall spine is provided for a modular office furniture system, the wall spine comprised of a plurality of individual panel assemblies. Each of the individual panel assemblies comprises a rigid frame assembly having a left end and a right end and a plurality of facing panels individually attached thereto. A crown member is attached to a top portion of the rigid frame assembly for supporting office furniture accessories. The left end of one of said individual panel assemblies is adapted to be secured to the right end of another of said individual panel assemblies to form the wall spine. In its preferred form, a cavity is formed between the rigid frame assembly and each of said plurality of facing panels.

The crown member preferably comprises an upper angled clamping surface, a lower angled clamping surface and an inclined mounting surface therebetween such that the lower angled clamping surface is generally spaced apart from the panel assembly whereby the crown member generally projects in an upward orientation. The crown member is adapted to engage a mounting bracket having a complimentary engagement surface such that the mounting bracket supports office furniture accessories thereon. A crown member may be attached to both sides of the rigid frame assembly, and include a recessed channel disposed between the respective upper angled clamping members.

BRIEF DESCRIPTION OF THE DRAWINGS

Various other objects, features and advantages of the invention will become more apparent by reading the following detailed description in conjunction with the drawings, which are shown by way of example only, wherein.

DETAILED DESCRIPTION OF THE PREFERRED EMBODIMENTS

Figure 1:
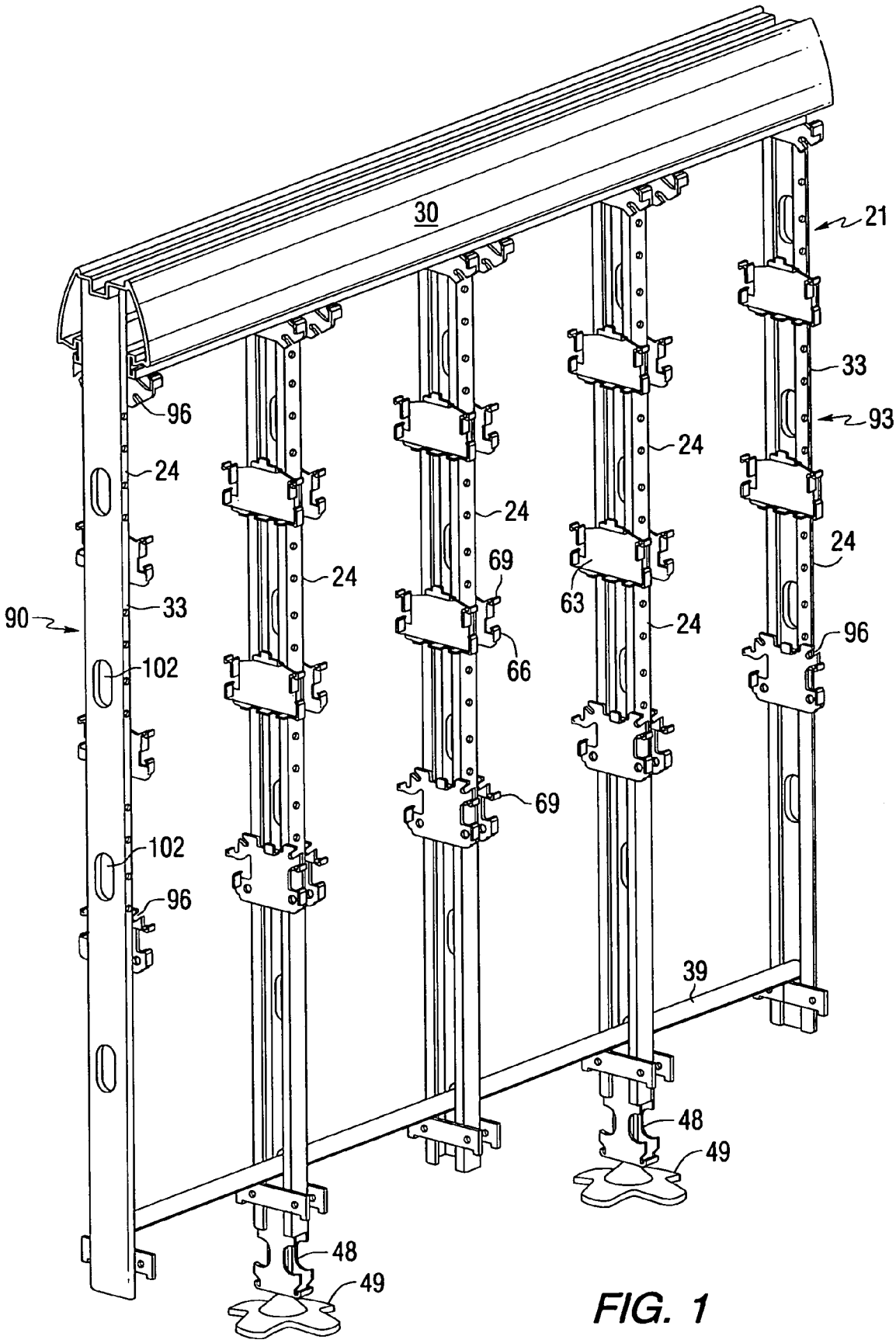
FIG. 1 is a perspective view of the vertical frame assembly for the wall panel of the present invention.
Figure 2:
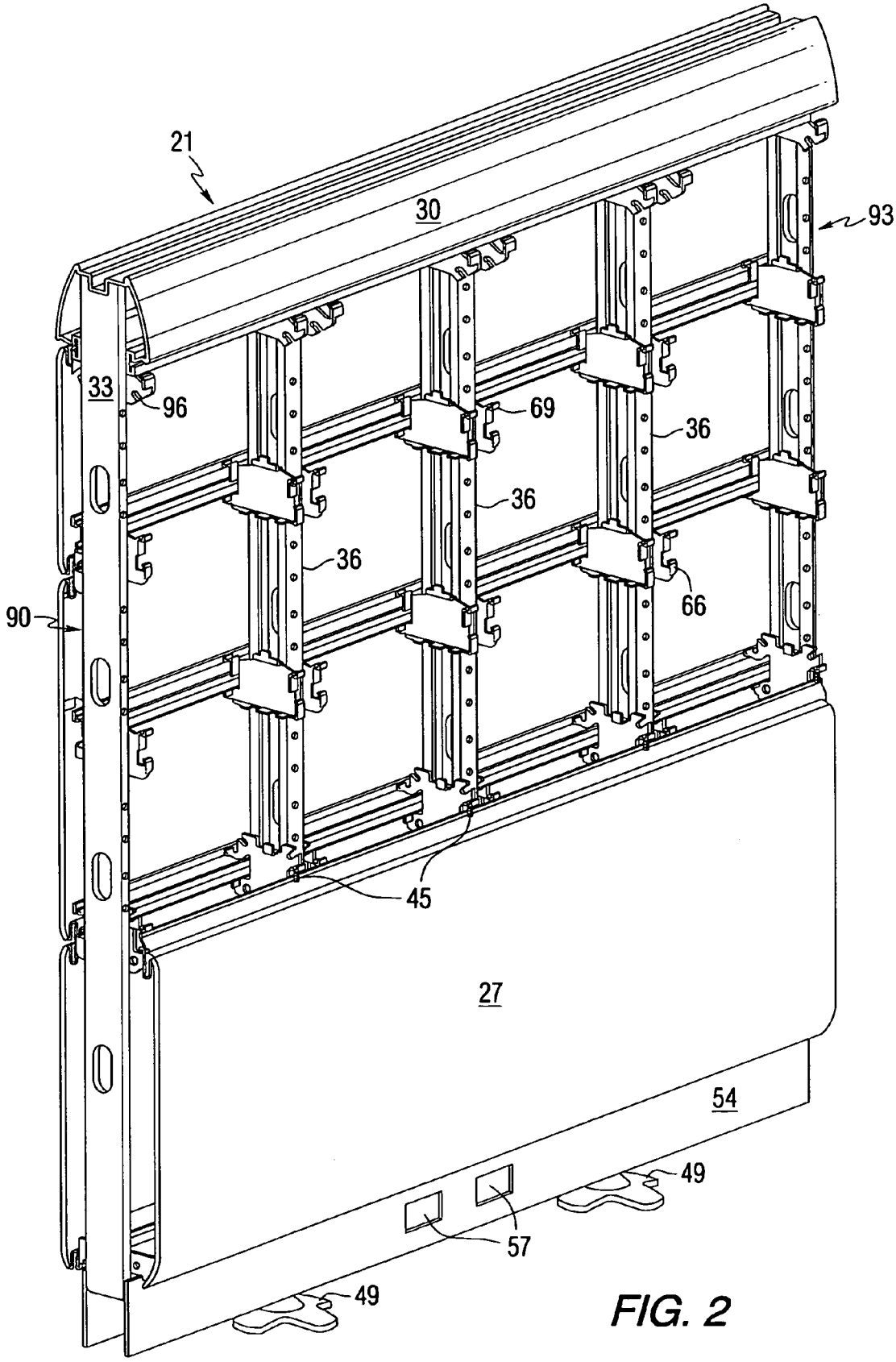
FIG. 2 is a perspective view of a partially assembled panel of the present invention.

Referring now to the drawings in detail, FIGS. 1 and 2 show an individual panel assembly 21 for a spine assembly of the present invention having a substantially open structure of vertical frame members 24 (FIG. 1) which, in combination with a mechanically fastened bottom facing panel 27, and preferably through the attachment of a crown member 30 (FIG. 2), provides a rigid framework resembling a box beam structure so as to provide the various mounting capabilities of the present invention. The hybrid panel construction is generally comprised of a plurality of vertical frame members which when assembled into a panel assembly resemble conventional architectural wall stud members. The frame members of the individual panel construction comprise two end vertical members 33 and at least one vertical upright support positioned therebetween. For a typical four (4) foot wide panel assembly 21, three intermediate vertical upright supports are provided. During construction of the panel assembly, a horizontal rod 39 is provided to maintain the vertical supports 24 in an upright position for ease of construction. If desired, this horizontal rod may be permanently attached, such as by welding, to the individual vertical frame support members. The vertical frame members 24 are thus rigidified within a box beam-like structure through the mechanical attachment of bottom facing panel members 27.

Figure 5:
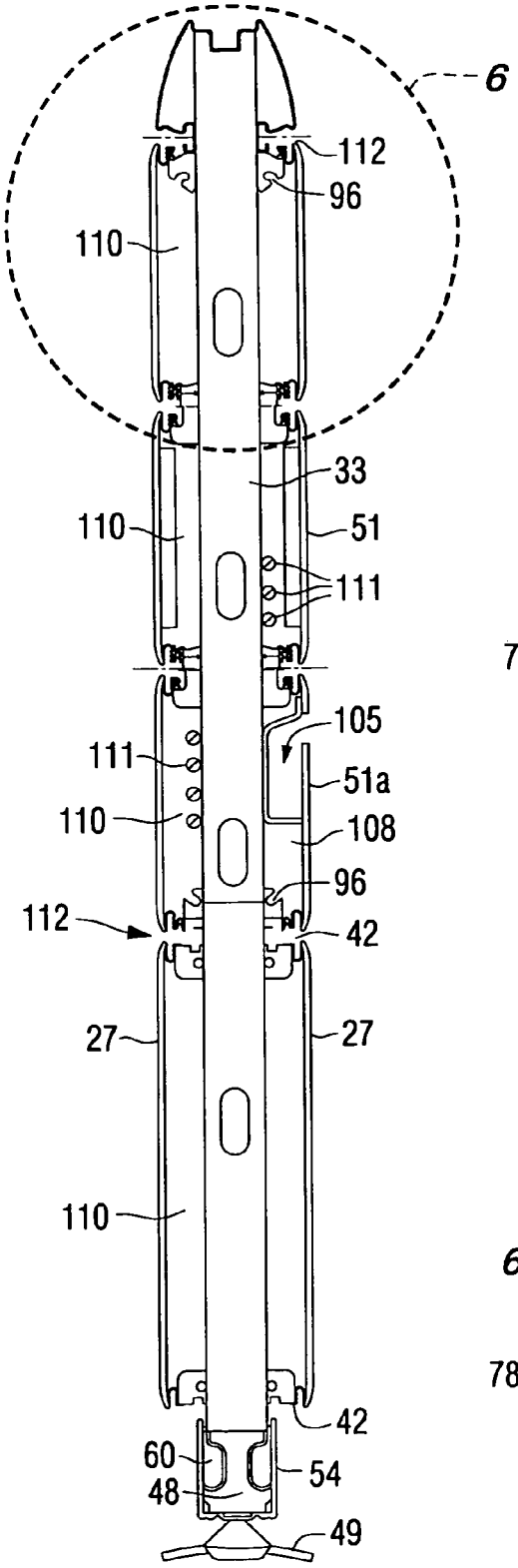
FIG. 5 is a side view of the panel assembly shown in FIG. 4.

Each of the bottom facing panel members, one attached to either side of the vertical frame members, preferably comprises a metal, such as steel, having attached at upper and lower portions a horizontal channel 42 (see FIG. 5). Preferably each of the upper and lower channels is securely attached, preferably welded, to the bottom facing panel assemblies 27. Alternatively, during forming or stamping of the bottom facing panels, the channels can be integrally formed therein. During construction, the bottom facing panel assemblies are mechanically affixed, such as by screwing or bolting 45, to the vertical frame assemblies 24 by means of the upper and lower channels 42.

Preferably, at least two of the vertical upright supports include base members or legs 48 so as to maintain the panel 21 in a level upright position. The legs are permanently attached to the uprights, again such as by welding. Each leg 48 also comprises a leveling adjustment mechanism 49 whereby each base member is independently adjustable in a vertical direction so as to maintain the individual panel assembly in a level position regardless of the surface upon which the panel assembly rests. Once constructed in such a manner, the vertical uprights 24, bottom facing panels 27, and legs 48 provide a rigid structure upon which a plurality of individual facing panel members 51, as well as other office system components, can be attached.

Attached to the vertical upright below the structural horizontal bottom facing panels is a conventional access panel and raceway construction 54. The bottom access panel also preferably includes openings 57 for the attachment of electrical or data module outlets.

Moreover, once constructed in this matter, the rigid frame assembly remains open at the bottom (see FIG. 4) to allow for the passage of electrical, data and communication cables upward through the frame structure in a manner that will be described more fully hereinafter. In the side view of FIG. 5 of the individual panel construction, in the area where the base members are attached there is also a channel 60 created by the legs 48 and access panel 54 for the horizontal routing of cabling to the outlets provided in the access panels.

Figure 3:
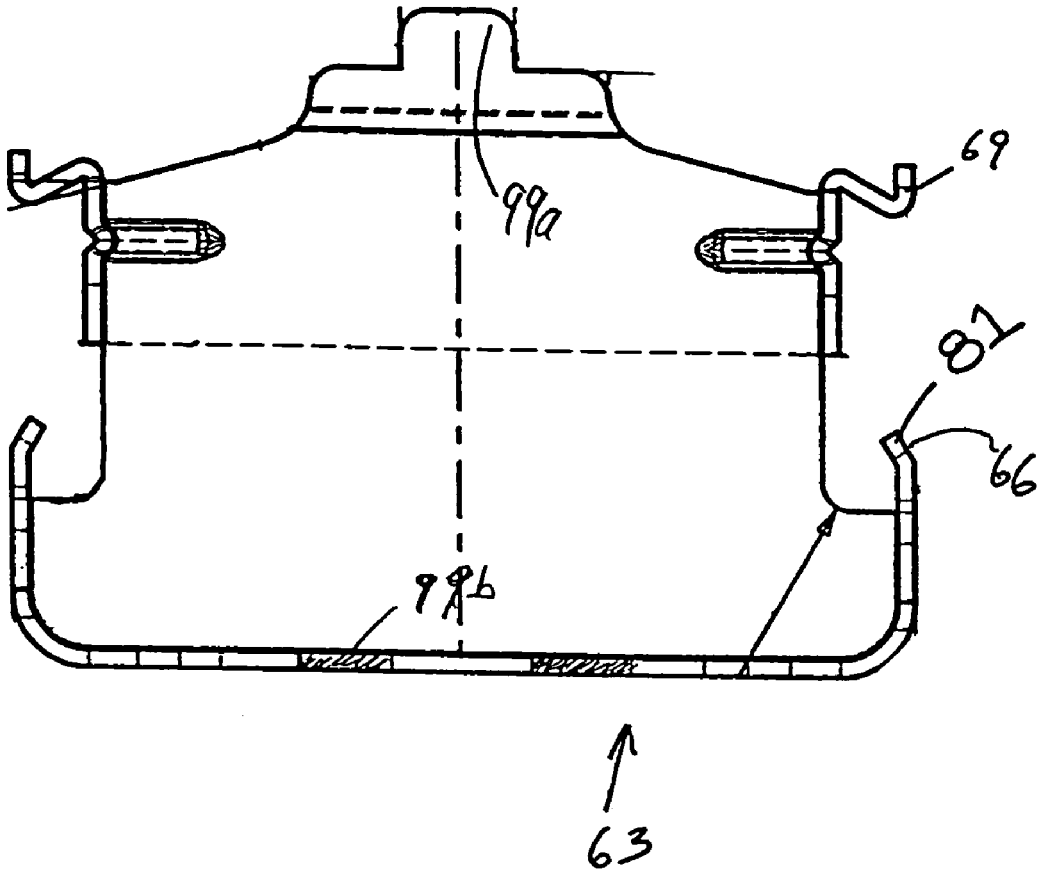
FIG. 3 is a detailed view of a mounting clip for attaching facing panels for the present invention.
Figure 6:
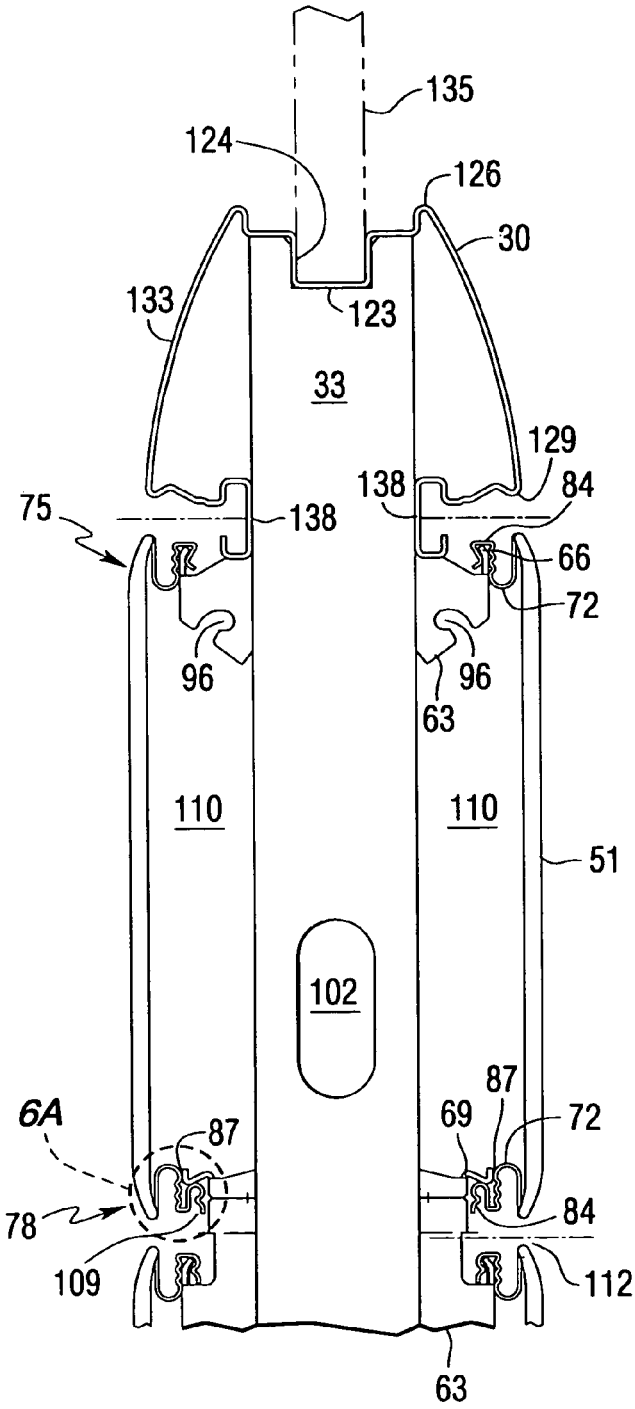
FIG. 6 is a detailed view of a facing panel support bracket mounted to the wall assembly according to the present invention.

Attached to each of the vertical uprights 24 at various vertical positions thereon are support brackets 63. These support brackets are shown in more detail in FIG. 3. The support brackets are permanently attached to the vertical frame supports 24 such as by welding. The support brackets are multi-functional components which can provide numerous attachment features for the spine and panel 21 assemblies. The support brackets 63 in the intermediate portion of the vertical frame assemblies comprise upper 66 and lower 69 facing panel attachment members. As shown in detail in FIG. 6, for example, a facing panel assembly comprises a plurality of individual facing panel members 51. Each facing panel member 51 is secured to the support brackets 63 by universal panel mounting clips 72 which are secured to the upper 75 and lower 78 portions of the facing panels. Preferably, the upper facing panel attachment member 66 (which is on the lower part of the support bracket 63) extends in a general vertical manner and has an angled portion 81 directed towards the vertical supports 24. The upper facing panel attachment member is adapted to be received in a first portion 84 of the facing panel mounting clip 72 on the upper portion 75 of the facing panel such that when the upper part of the facing panel is attached to the support bracket 63 it can be swung down so that the outer surface of the first portion of the facing panel mounting clip 72 on the lower portion 78 frictionally engages the lower facing panel attachment member 69 of the support bracket. The lower facing panel attachment member generally comprises an S-shaped clip (which is on an upper part of the intermediate support bracket) which frictionally engages the lower portion facing panel mounting clip 72 and abuts against a second portion 87. As can be seen in FIG. 6, the universal upper and lower panel mounting clips are of preferably the same shape such that the facing panel can be mounted in any horizontal orientation.

As previously stated, the intermediate support brackets 63 comprise the upper and lower panel attachment members, whereas the lower array of support brackets 63 include only a lower facing panel attachment member 69 so as to engage the lower portion 78 of an associated facing panel 51, and may include means such as bolt holes, to mechanically fasten the bottom facing panel to the vertical supports. Moreover, the array of support brackets 63 toward the top of the vertical supports 24 comprises only an upper panel attachment member 66 to engage the upper portion 75 of a facing panel attached thereto.

A further detail of the support brackets can be seen on the brackets 63 that are attached to the end vertical members 33. The support brackets on the two end vertical members of the spine assembly are only provided on one side of the vertical uprights. By comparing the left 90 and right 93 members (as shown in the figures) of the vertical supports, it can be seen that when two panel assemblies are placed side by side so as to form a length of wall, the right hand end vertical support 93 of the first panel member abuts against the left hand vertical end support 90 of a second panel member. The end supports 33, moreover, are of a width which is one half the width of an intermediate vertical support member 36, such that when the two panels are placed end to end the two combined left hand and right hand vertical supports provide a vertical support 24 which is identical to the width of one of the intermediate members. In this manner, the spine wall assembly has vertical supports of uniform width along its length so as to provide a uniform mounting arrangement for the horizontal facing panels, as well as interior mounting of accessories and components.

In order to attach individual panel assemblies in an end to end fashion such as to provide the basic spine for the office system, the left side of one panel can be securely attached to the right side of a compatible panel. The upper and lower arrays of support brackets have formed therein a channel 96 for receiving attachment assemblies (not shown). The attachment assemblies preferably comprise a barrel member and bolting members. The barrel member is sized to fit between the upper and lower support brackets on either side of the vertical supports. In one embodiment, the barrel member has threads on the interior portion such that one screw can be attached at one side to hold the right panel whereas a complementary screw is attached to the left side to hold the left panel. Alternatively, the barrel member may merely provide a sleeve to receive male and female bolt members which are threadingly engaged within the barrel. In either scenario, the heads of the bolts engage the channels 96 of the respective upper and lower support brackets 63 such that when the bolts are threaded either to each other or to the barrel members, the upper and lower support brackets and end vertical supports are securely attached to each other. Such attachment assemblies are well known in the art. As the support brackets 63 are permanently mounted to the vertical supports 24, the attachment assemblies thus provide for secure attachment of individual panels 21 to each other in a horizontal, end to end fashion to construct the spine assembly.

A further detail of the support brackets is that the brackets provide a second mounting arrangement 99 in a facing relationship. An upper tab 99*a* on the support bracket 63 is adapted to receive, for example, a power module or a data outlet module. The lower portion of the support bracket preferably includes two slots 99*b* for attachment of power modules therebetween such that the power module can be hooked to opposed support brackets 63 in a fully supported manner between vertical supports 24. Most preferably, the vertical supports are spaced having a nominal distance therebetween of one foot (12 inches). A typical power outlet module which may be attached therebetween is generally 6 inches in length such that either one or two such modules can be secured between the vertical supports 24. Additionally, the vertical uprights may also provide openings 102 therein so as to provide for wiring to be passed through the vertical supports in a conventional manner.

Figure 4:
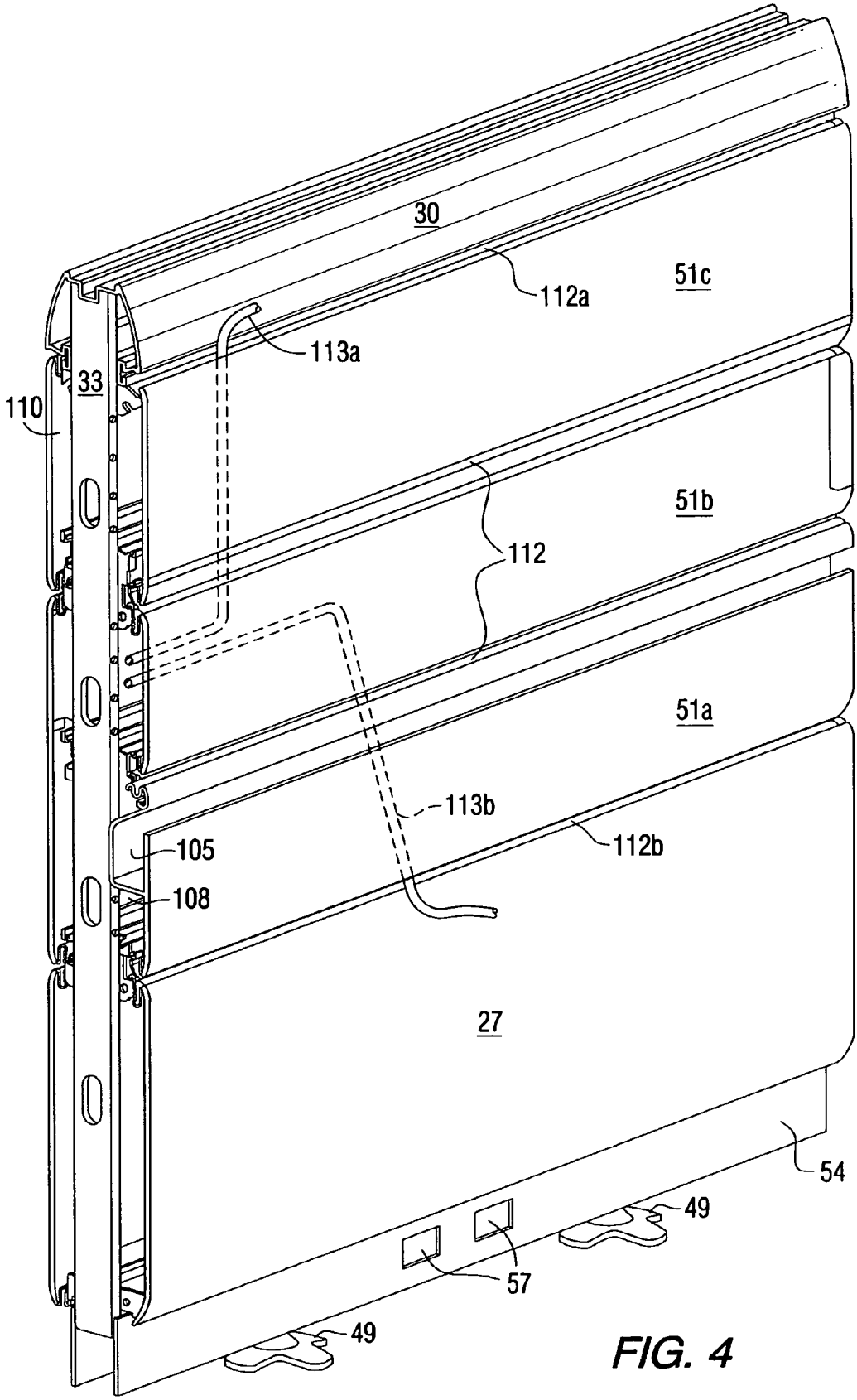
FIG. 4 is a perspective view of a fully assembled wall panel according to one embodiment of the present invention.

Referring in particular now to FIGS. 4 and 5, a typical fully assembled individual panel assembly 21 is shown therein. The individual panel assembly is comprised of the rigid support provided by the vertical uprights 24 and the mechanically affixed bottom facing panels 27, such that any type of intermediate facing panels 51 can be attached to the vertical supports. One detail is shown in FIG. 5 wherein the second row of horizontal, facing panels 51*a* (i.e., directly above the bottom facing panels) comprises a slot 105 in an upper portion and a channel 108 in the lower portion. In a manner which will be described more fully hereinafter, the upper slot 105 provides a "hideaway" portion for tucking in cables and the like so as to provide an unobstructed work area. Moreover, if desired, the lower portion of this panel preferably comprises the channel 108 which is the main raceway for electrical cable distribution.

Also as shown in the side view of FIG. 5, a horizontal cavity 110 is provided between each of the facing panels 51 and the vertical supports 24. In this manner, at any vertical height along the individual panel assembly other cables 111, such as electrical, communication or data cables, can be routed through the individual panel assembly 21 quite easily. A recess may be provided near the top of the facing panels such that relatively light accessories, such as an individual work light, can be supported from the horizontal panels 51 anywhere along the length of the wall.

Figure 6A:
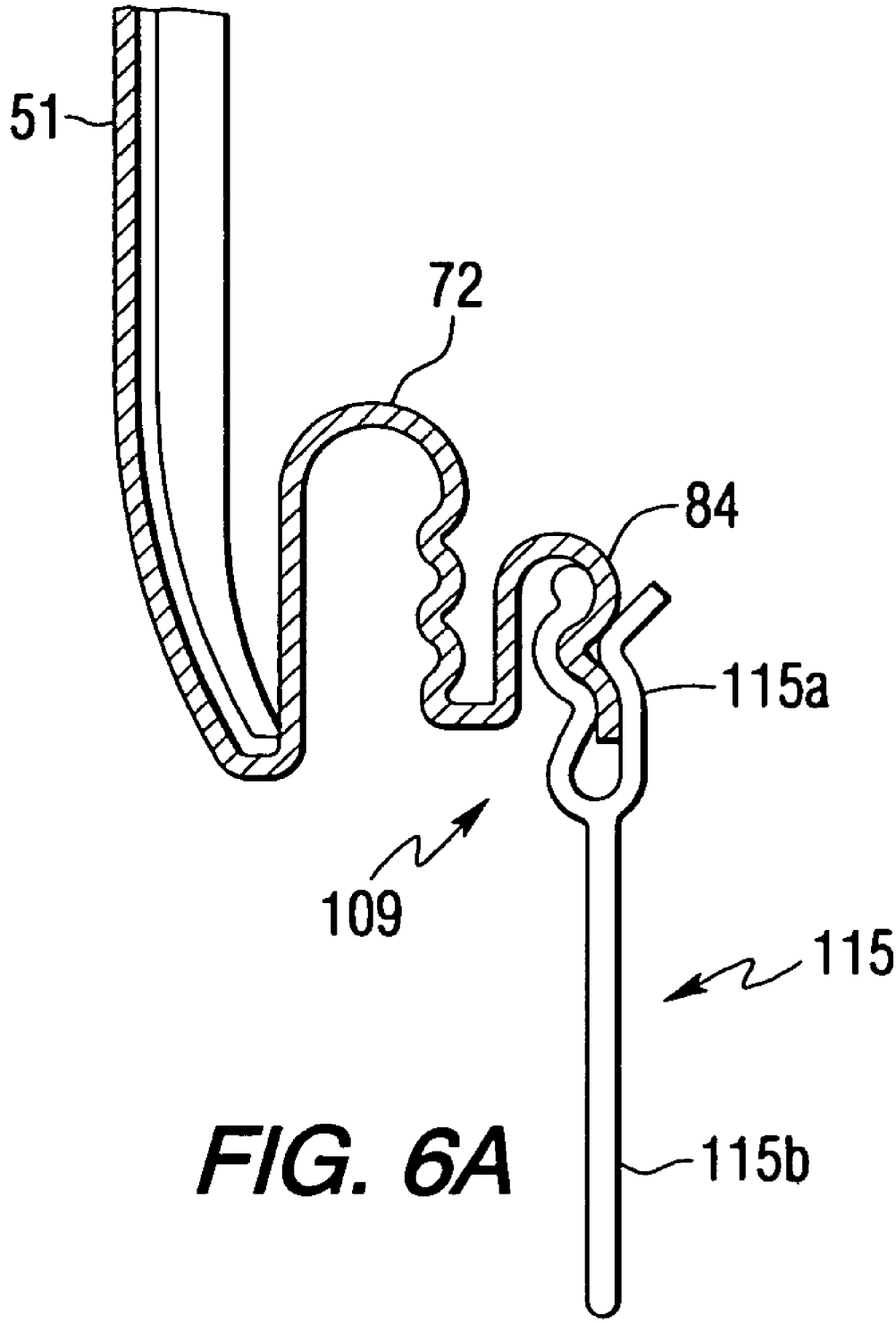
FIG. 6A is an enlarged view of the encircled area of FIG. 6 further illustrating a flexible sight barrier.

While the panel assembly 21 is shown having horizontal facing panels 51 which span the length between the end vertical supports 33 and fit between rows of support brackets 63, it is to be understood that facing panels may be full length such that they span the vertical height between the crown member 30 and the bottom facing panel 27, as well as horizontally across individual panel assemblies 21 or partial-length panels between vertical supports. Thus, the present invention provides numerous office layout and design options. As shown in phantom in FIG. 4, ingress and egress for cables is provided at a plurality of vertical levels. In a panel assembly having a plurality of facing panels 51, cables 111 can be routed into or out of the panel assembly 21 at any or all of the horizontal joints 112. A flexible sight barrier 115 may be provided to cover each of the horizontal joints 112 to provide a more aesthetically pleasing appearance. The sight barrier 115 preferably comprises a one-piece strip of elastomeric material, such as polyvinylchloride (PVC), which consists of a dual durometer having top portion 115*a* that is rigid and can be frictionally retained by the panel mounting clip 72 by a hook or other means, such as shown in FIG. 6A, or may be slid into the opening 109 formed with joint 112 by panel mounting clips 72 of vertically adjacent facing panels 51. The bottom portion 115*b* of the sight barrier is flexible, enabling the sight barrier to be easily deflected to permit the ingress and egress of cables 111. As shown in FIG. 6A, which is an enlarged view of the circled area of FIG. 6, the sight barrier 115 frictionally engages the first portion 84 of the facing panel mounting clip 72. By way of example, a cable 113*a* which is horizontally routed through the panel assembly can be routed upward (or downward as in the case of cable 113*b*) through the generally open support frame assembly, either between vertical frame members 24 or secured to one of the supports, to project out of the panel assembly at the horizontal joint 112*a* between, for example, the crown member 30 and top facing panel 51*c* (or out of the joint 112*b* between the second row facing panel 51*a* and the bottom facing panel 27). Additionally, if a light fixture (not shown) is attached to the crown member 30, its electrical cord can be inserted into the horizontal joint 112*a* and routed downward such that egress is provided for the electrical plug at another of the horizontal joints which may be adjacent a panel having electrical outlets. In this way, such cables are hidden so as to not obstruct the outward appearance of the panel or interfere with the work area.

In order to attach cabling to the vertical support in a conventional manner after the individual panels have been fully assembled, a person need merely pull on the lower portion 78 of the facing panel such that the frictional engagement of the lower portion facing panel mounting clip 72 is released from the lower facing panel attachment member 69 of the support bracket on the vertical support. If a cover strip (not shown) is provided to mask the horizontal joint 112 between facing panels 51, it is first removed. The facing panel 51 can then be swung upward by pivoting on the upper facing panel attachment member 66. This provides unobstructed access to the horizontal cavity 110 within the horizontal facing panel such that electrical or communication wires can easily be installed. Optionally, the facing panel may also include a power outlet in the lower portion anywhere along the horizontal length of the facing panel. It should be readily apparent that any of the facing panels may include cable outlet modules to enable power, data or communication cables to be passed through at any location along the wall.

Figure 7:
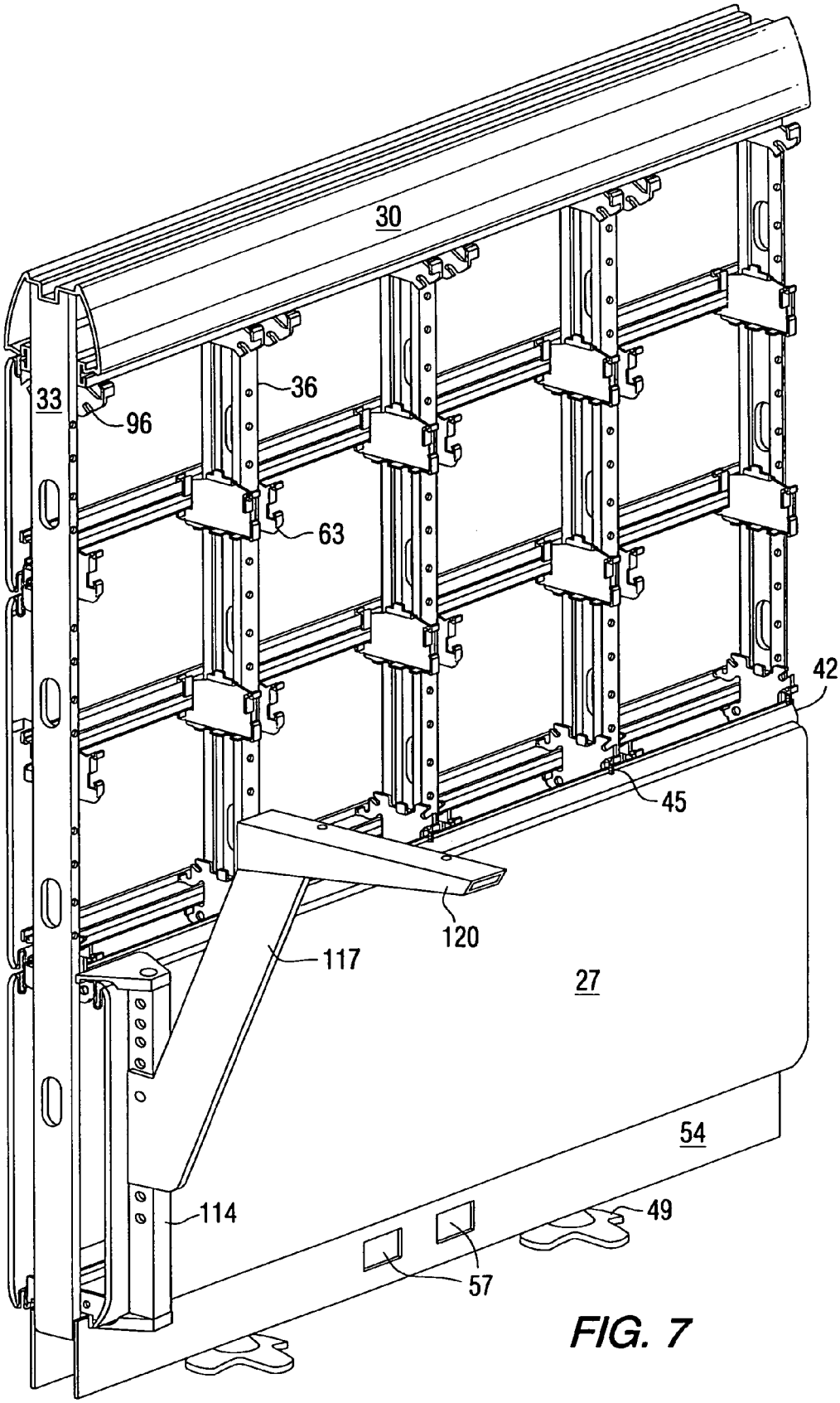
FIG. 7 is a perspective view of a partially assembled individual panel according to a second embodiment of the present invention showing a support bracket.

One further advantage of the present invention can also be seen in referring to FIG. 7. The upper and lower channels that are permanently attached to the bottom horizontal facing panels are adapted to receive lower support brackets 114 anywhere along the horizontal length of the panel assembly or wall. These brackets 114 are used for attaching work surface supports, stabilizer feet or panels, or perpendicular partitions. The embodiment of FIG. 7 shows a cantilever arm 117 which is secured to the bracket attached to the channel in the bottom facing panel 27. This cantilever arm has a range of vertical motion and is adapted to receive on its upper bracket 120 a desktop or other work surface. The desktop can be readily screwed to the upper bracket 120 by the holes provided therein. Since these support brackets 114 are attached to the upper and lower channels in the bottom horizontal facing panel, the desktop can be attached anywhere along the horizontal length of the wall. Attaching to this portion of the wall, which in the preferred version is below the work surface level, leaves the remainder of the wall free of perpendicular attachments and thus accessible for unobstructed lay-in of wiring.

Figure 8A:
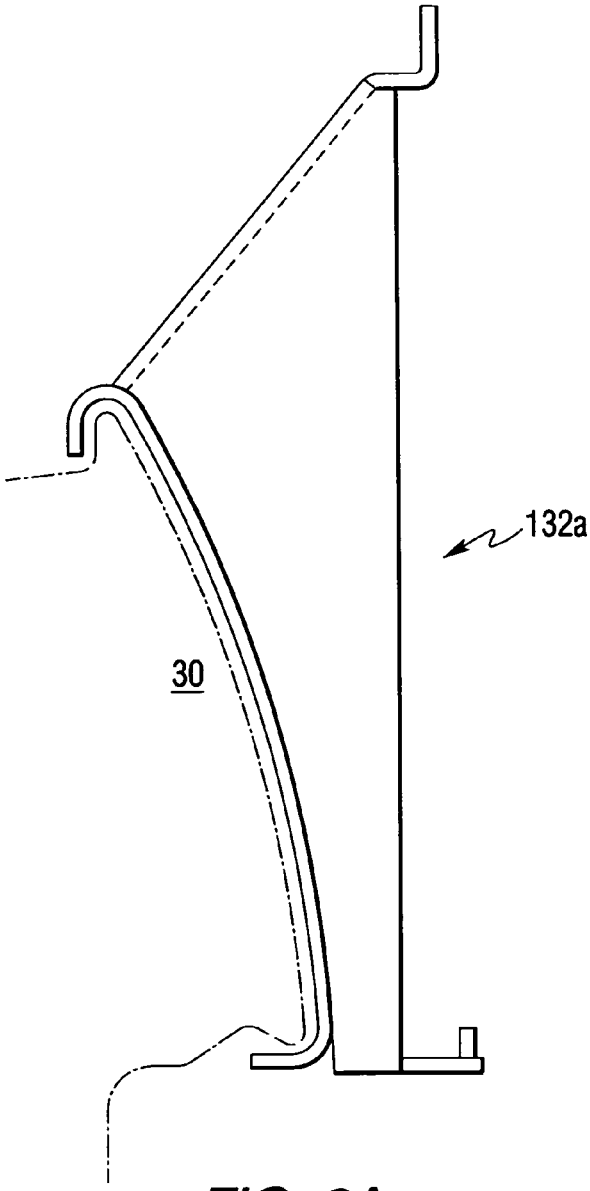
FIGS. 8A and 8B are a detailed views of mounting brackets for attaching components to a crown member.
Figure 8B:
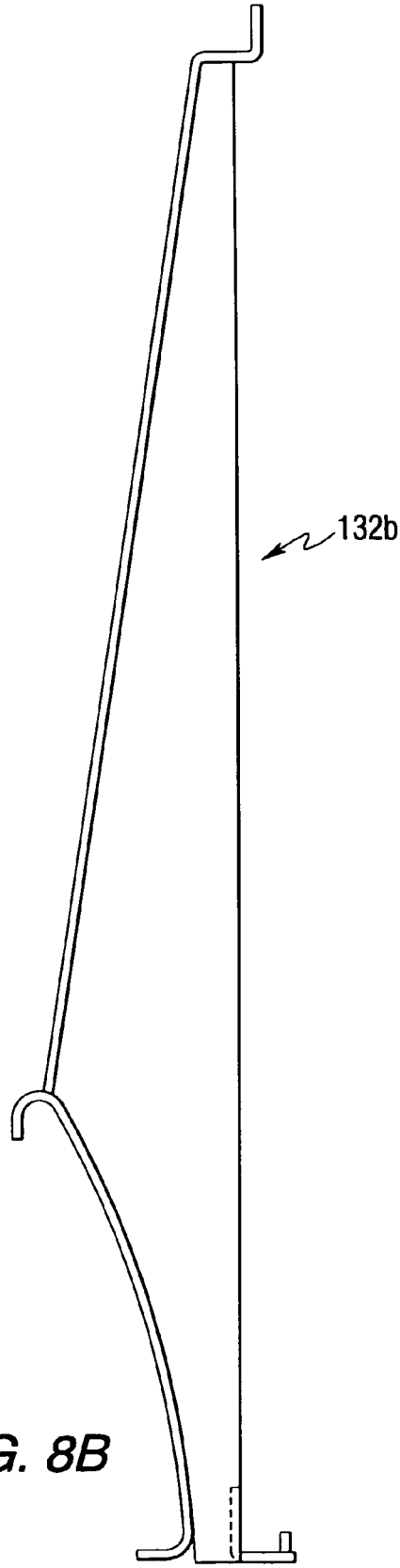

Attached to the upper portion of the vertical supports 24 is the crown member 30. The crown member, in addition to providing a decorative and visually pleasing end member for the vertical supports, provides for many functional elements for the versatility of the wall panel or spine construction. As can be seen in the side view of FIG. 6, the crown member attaches over both sides of the vertical supports 24. In this embodiment of the invention, although the crown member is shown as an integral piece, it may be made of two half portions which are attached to each other along the length of the individual panel assembly 21. Preferably, the crown member comprises a welded seam along its length. Moreover, the upper portion of the vertical support members comprise a channel 123 which is adapted to receive a channel 124 formed in the crown member 30. On each side of the crown member are top 126 and bottom 129 angle portions which are adapted to receive an accessory bracket 132 (FIG. 8) upon which can be mounted overhead fixtures or accessories such as a storage cabinet, shelves or lighting fixtures above the level of the work surface in a manner which provides an unobstructed work area. The crown preferably has an inclined face 133 between the top and bottom angle portions, such that the bottom angle portion 129 is generally spaced a distance outward from the vertical support 24. The top and bottom angle portions receive the complementary formed accessory brackets which can be attached to the crown members 30 anywhere along the horizontal length of the individual panel assemblies 21. The accessory brackets 132 shown in FIGS. 8A and 8B which are formed in a complementary manner to the crown members allow for the "upmounting" of accessories at various heights on the individual panel. Although the crown 30 is shown having slanted sides, it may comprise any cross-section, such as a square crown member having vertical faces, which permits the attachment of complementary formed upmount brackets. Alternatively, the accessory mounting brackets can be formed such that the accessories are disposed below the vertical height of the crown member 30, referred to as "downmounting" of such accessories. This provides the desired advantage of allowing for attachment of a myriad of accessories so as to provide for a flexible design concept.

In addition, the complementary channels 124, 123 formed in the crown 30 and vertical supports 24, respectively, provides a means for adding to the vertical height of the panels. In a preferred embodiment, the channel comprises slanted sides such that the add on vertical panels are mounted to the wall portion by sliding the add-on vertical panels 135 (shown in phantom in FIG. 6) into the channel 124. In this manner, the vertical extensions are held in a semi-locked position with respect to the wall panel such that they cannot be inadvertently removed from the individual panel assembly.

On a lower portion of the crown member is provided a generally C-shaped attachment bracket 138. This C-shaped bracket allows for the attachment of other accessories along the horizontal length of the wall, so as to provide for the mounting of accessories below the upmounted components. For higher profile panel assemblies, in which it may be impractical to include the upmount brackets, overhead accessories can be attached to the panel assembly by means of the C-shaped attachment bracket 138.

As we will be described more fully hereinafter, the crown member 30 can comprise a half portion such that the wall panel assembly is used in a manner such as for an individual workstation.

The multi-functional horizontal structural shape of the crown member in addition to capping the top of the wall structure thus provides useful multiple attachment means on its outer faces. The crown member also provides a measure of rigidified support for the beam arrangement of the spine assembly. If desired, the crown member can be permanently attached to the vertical supports such as by welding. If welded, preferably spot welds are provided at the channel at the top of the vertical supports as well as the C-shaped brackets on either side of the vertical support in the bottom of the crown member halves. The crown member 30 allows for a spine assembly which is relatively low in height to encourage communication between individuals within the work area, which is especially useful in accommodating for dynamic team organizations, while allowing for selectively increased height by the extension panels 135 inserted in the channel 124 in areas needing more enclosure. Furthermore, required storage capacity is provided above the work surface having adequate clearance between the work surface and the upmounted or downmounted storage accessory.

Flexibility in mounting locations for the storage units and other overhead accessories as well as add up vertical extensions for the wall sections is most desirable for off module workstation planning along the central spine. The crown member 30 provides a structural beam adding extra rigid support to the top horizontal frame member, while providing a visible and decorative top cap shape 133. The symmetrically opposed incline faces having the acute returns on the top and bottom angle portion of the crown member, allow for the fixing of bracketry 132 (as shown in FIG. 8) for mounting the storage components or accessories anywhere along the horizontal length of the spine assembly. In addition, the continuous integral channels 138 below the incline faces can hang other components. In conventional prior art panel assemblies, the frames are constructed such that components can only be attached thereto at specified locations. The crown member 30 permits attachment of such accessories at any horizontal length along a single panel assembly 21, or may even span horizontally joined panels in the wall spine. Moreover, the upmounting and downmounting feature allows for accessories to be supported at various vertical heights. Therefore, panel and office accessories and components can be attached via the crown member 30 in a non-modular configuration.

Figure 9:
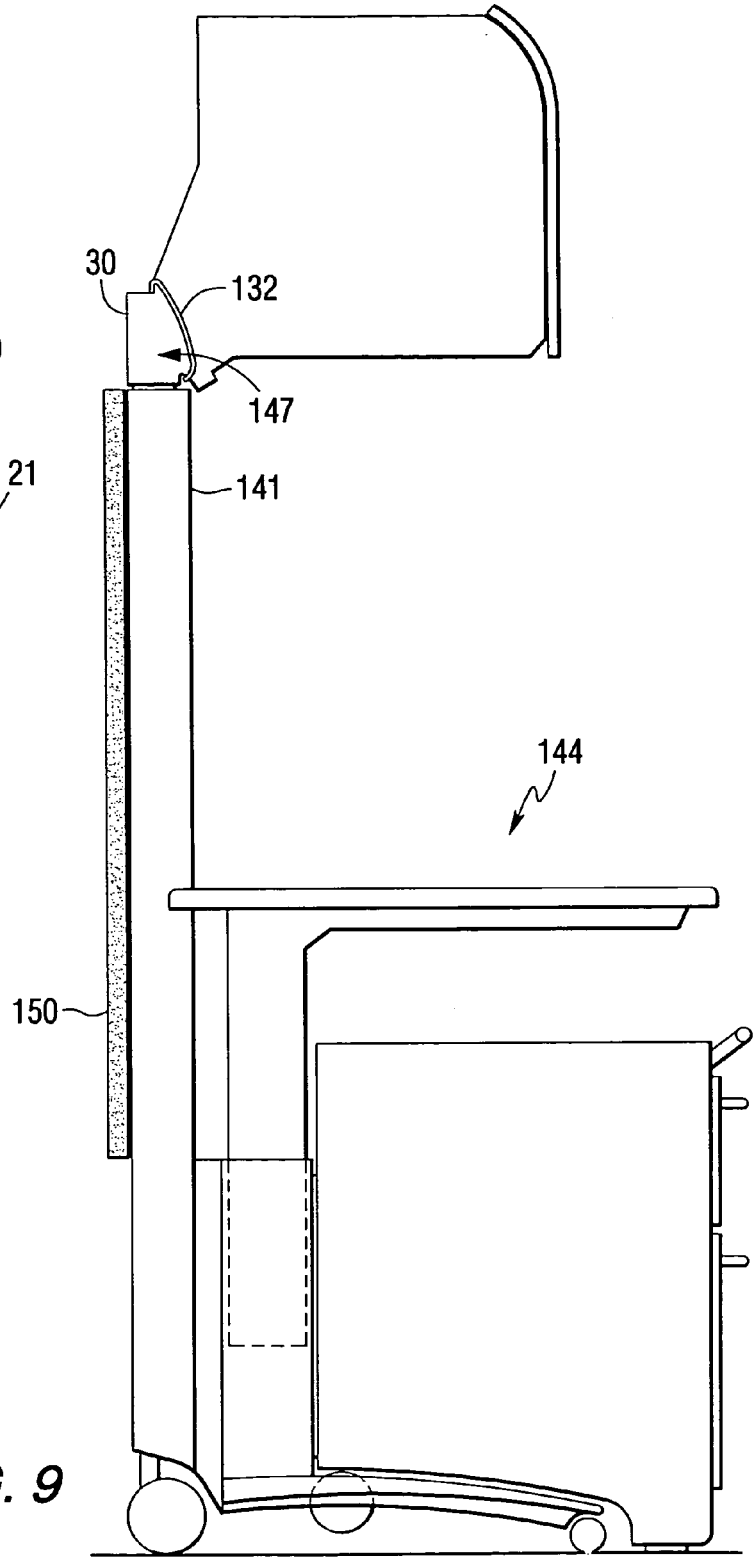
FIG. 9 is a perspective view of an alternate embodiment of the crown member attached to a conventional desk unit.

As shown in FIG. 9, the crown member also allows a single or conventional wall panel assembly to be modified to provide upmounting capabilities. Vertical stanchions 141 can be attached, for example, to a conventional desk unit 144 which stanchions accept a mounting beam rail 147 upon which a half crown member 30 is attached. The half crown member provides the decorative and functional cap portion while a conventional privacy screen 150 can still be attached to the back of the vertical supports in a well known manner.

Along the horizontal length of the channel 124 in the top crown member can be provided slots or other openings which can provide multiple functions. The slots can be used to either provide added support for the vertical extension members 135, or can be used to pass wiring therethrough such as to provide a source of electrical power for lights or other electrical components attached to the crown member 30.

Figure 11:
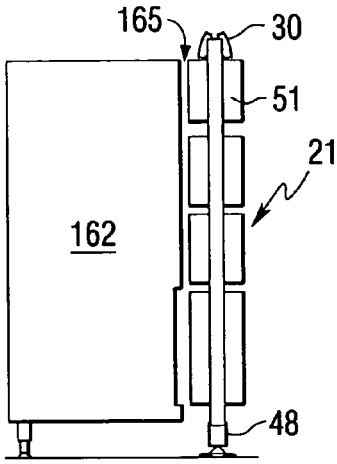
FIG. 11 is a perspective view of a third embodiment of the present invention wherein a conventional panel assembly is attached to the spine assembly.
Figure 10:
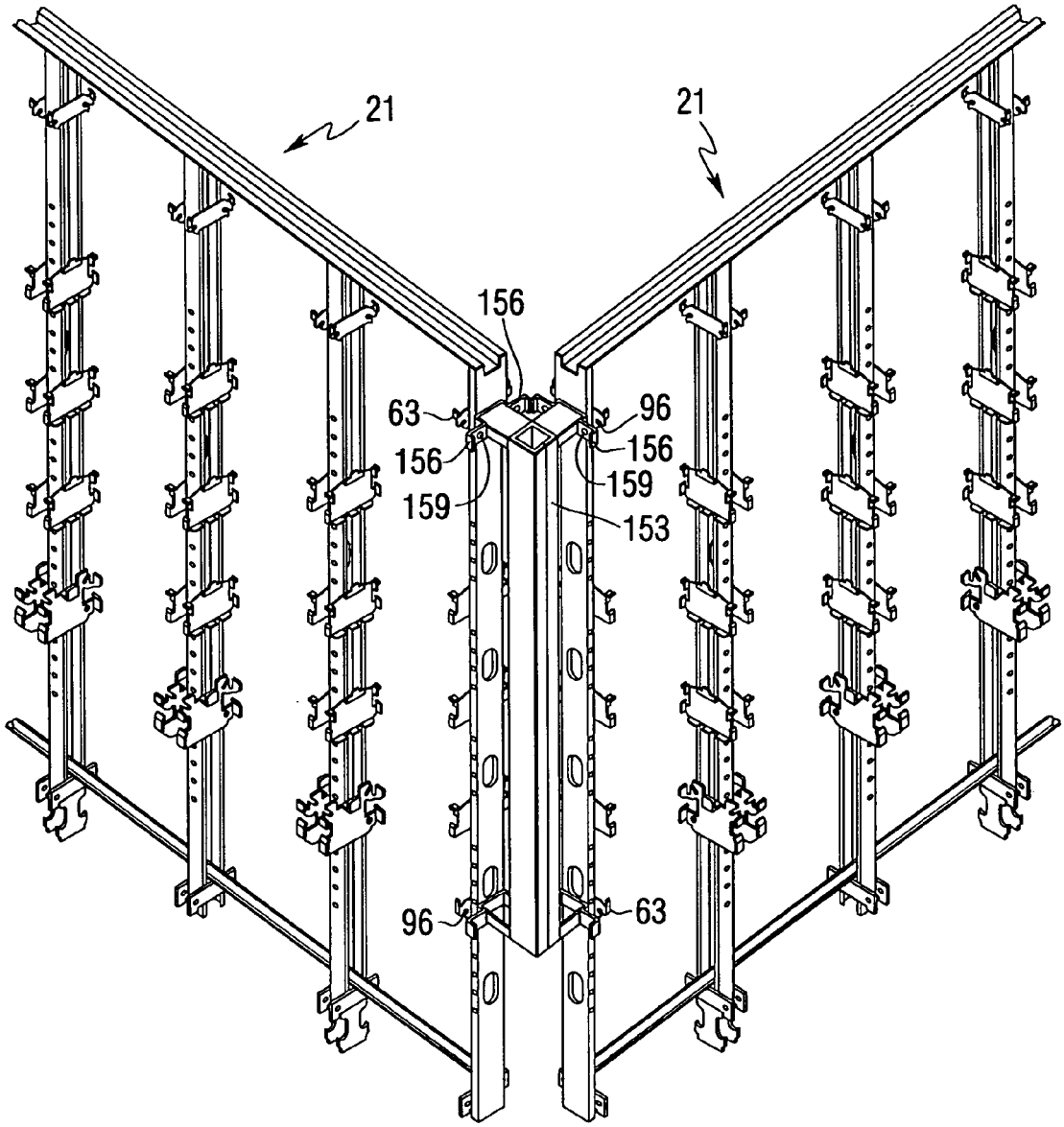
FIG. 10 is a perspective view of a corner vertical support.

When it is desired to provide either and L-, T-, or X-shaped connection at the end of a panel, the corner vertical support post 153 as shown in FIG. 10 may be utilized. In the L-shaped corner post as shown in FIG. 11, each leg of the L comprises a support bracket member 156 having an opening 159 to receive the barrel attachment assemblies. The opening may be a bolt hole or channel as is provided in the support brackets 63. By way of example, the L-shaped vertical post can be attached to one end of a panel assembly, and the next panel is thus attached in a perpendicular relationship to the first panel. In this manner then, further panels 21 can be attached at either end of the L-shaped bracket to provide an L-shaped work area of any, respective, horizontal length. As will be readily apparent to those skilled in the art, instead of an L-shaped post, a T- or X-shaped vertical support post may be provided so as to provide a spine assembly which has these angled relationships. Thus the wall assembly of the present invention provides the flexibility needed in modern office systems.

In addition to the rigid L-shaped bracket which can be utilized to provide a perpendicular connection to a wall assembly, the bottom horizontal facing panel is adapted to receive a conventional full-sized panel or partition assembly. As shown in FIG. 11, a conventional full size partition panel 162 can be mounted to the bottom horizontal facing panel and secured thereto, such as by using the support brackets 114. In this configuration, an opening 165 is created between the perpendicular partition 162 and the wall panel 21 of the present invention to allow for both individual horizontal facing panel 51 removal and the lay-in of wiring after the partition assemblies have been assembled. If desired, more perpendicular partitions can be attached to the wall panel of the present invention anywhere along the length of the individual panel, in much the same flexible manner as other components can be attached to the hybrid panel assemblies. Thus, numerous options and design configurations are available to the office designer.

If necessary in order to provide added stability for the vertical wall assembly, a stabilizer leg can be supported to the support brackets on the bottom horizontal facing panels. The stabilizer legs can alternatively be clamped directly to the channels which are provided in the bottom facing panels.

Figure 12:
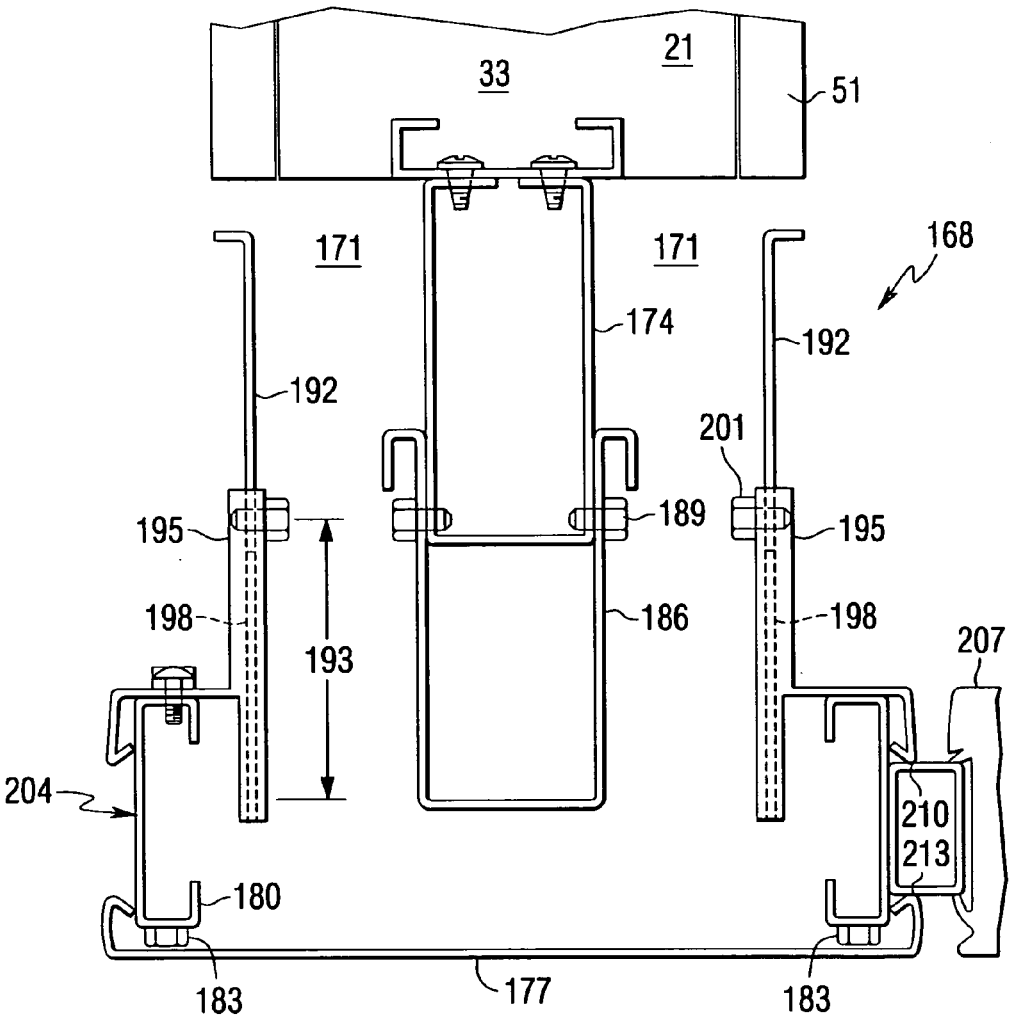
FIG. 12 is a top plan view of a telescoping end post for the panel according to a third embodiment of the present invention.
Figure 13:
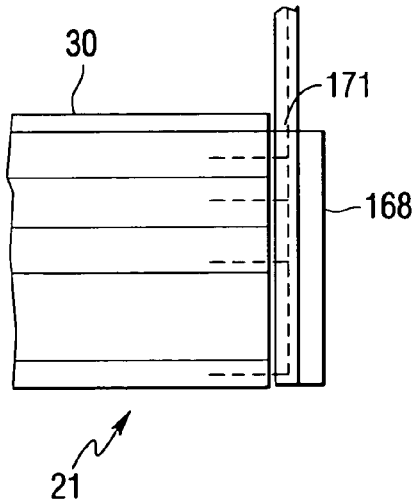
FIG. 13 is a perspective view of one use for the telescoping end post with the panel assembly of the present invention.

In another embodiment of the invention as shown in FIGS. 12 and 13, a telescoping vertical end post 168 is provided. This post can be provided on the end panel of a vertical wall as a termination point or as a means to attach a perpendicular divider panel 162. In this manner, a decorative end is provided to a wall which is placed in an open office area that is visual to personnel. The vertical end post 168 provides stabilizing functions for the end panel and connects perpendicularly to the end of an office system wall. The telescoping feature allows the length of the wall between perpendicular ends to be stretched so as to accommodate various designs.

This telescoping end post also provides an office designer with the ability to have a continuous length of wall against which perpendicular partitions can be located at any point without predetermining the number or location of these partitions.

As shown in the figures, the telescoping vertical end post 168 allows a length of wall to be extended to accommodate the thickness of perpendicular partitions. An additional feature of this end post is to provide a clear vertical space for lay in of vertical wiring 171 which is provided by a conventional ceiling in-feed wire enclosure. The telescoping end post comprises a mounting member 174 which is secured to an end vertical support 33 of a panel frame assembly 21, a removable outer cover 177, and a perimeter frame 180 which is attached between the mounting member and the outer cover. The outer cover is removably attached to the frame 180, such as by screws 183. The preferably metal (steel) perimeter frame 183 receives the outer cover at the end portion and on the opposite side receives telescoping components. A first portion 186 of the telescoping component is attached to the frame 180 and is horizontally adjustably affixed to the mounting member 174 on the panel frame assembly by a slot (not shown) formed therein. The first portion thereby forms a sliding panel with respect to the mounting member and is secured in the slot by bolts 189. The mounting member 174 which is fixed to the end vertical support of the spine wall panel 21 provides for a defined space between it and a sliding panel 192, which allows for the vertical in feed 171 of cable. In order to accommodate the various lengths that can be provided in the wall panel, a preferably 2.375 inch adjustment range 193 is provided for the end panel.

Preferably, each of the lateral faces of the telescoping end post 168 includes a sliding panel 192 to close the gap created by, for example, horizontally extending the frame 180 of the end post. The perimeter frame 180 includes, on either side, lateral mounting members 195 having slots 198 (shown in phantom). The slots receive the adjustable lateral sliding panels 192, which can be horizontally adjusted with respect to the spine or panel assembly 21 and the telescoping post outer cover 177. When the outer cover is adjusted to the desired horizontal position, the lateral sliding panel screws 201 are loosened so as to correspondingly adjust the lateral sliding panels 192 within the slots 198 to span the horizontal distance between the outer cover 177 and the panel assembly 21. When so adjusted, the screws are tightened to maintain the telescoping vertical end post in its desired position. A vertical face 204 of the frame 180 is adapted to be connected to a conventional wall or privacy panel 207 having a connector 210. The connector is secured to the frame 180 by securing the outer cover 177 to the frame, thus capturing the privacy panel 207 between the grip members 213. In this matter, a privacy panel or other partition can be secured to the end of the panel assembly 21 anywhere within the span of the adjustment range 193.

Thus, the hybrid panel construction of the present invention provides a versatile means for creating an open office system. The main individual panel construction provides a stable vertical support for the attachment of horizontal facing panel members. The facing panel members are attached to the vertical supports such that a clearance (preferably on the order of one inch) is provided between the facing panel and the vertical supports for the lay in of wiring. Since the horizontal facing panels are easily removable from the vertical supports, wiring can be added to the office system at any time. Moreover, since a variety of horizontal facing panels can be attached to the vertical supports, an individualized workstation can be provided having power modules or data communication modules connected anywhere along the horizontal length or vertical height of the individual panels. Moreover, since perpendicular partitions can be added anywhere along the length of the spine assembly, numerous open office design layouts can be constructed with the present invention. In addition, the crown member allows for the upmounting of components and accessories, such as bookshelves or lighting fixtures, in a manner which provides the unobstructed work space for the individual. The lower box beam assembly readily accepts supporting brackets to attach heavier components, such as a desktop mounted on cantilever supports. And the telescoping end posts allow the length of the spine wall between perpendicular ends to be stretched to accommodate the thickness of perpendicular partitions. Therefore, with the present invention, the office designer is not locked into a design concept which is rigidly fixed to the length of an individual panel assembly.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

The invention claimed is:

1. A panel assembly for a modular office furniture system, the panel assembly comprising:

a rigid frame assembly comprised of a plurality of spaced apart vertical frame members arranged in a common plane, each frame member having a plurality of support brackets attached thereto;

a plurality of individual facing panel members having a front side, a mounting side, a top portion and a bottom portion, the mounting side including means for individually mounting each of said plurality of facing panel members to said support brackets such that a plurality of unobstructed cavities are formed creating linear paths between all of the plurality of vertical frame members which comprise the rigid frame assembly and each of said plurality of facing panels; and a crown member attached to a top portion of the rigid frame assembly, the crown member adapted to mount thereon office furniture accessories.

2. The panel assembly as recited in claim 1, further comprising a pair of bottom facing panels, each of said bottom facing panels attached to at least two of the plurality of vertical frame members so that a box beam structure is fabricated to form the rigid frame assembly.

3. The panel assembly as recited in claim 1, wherein the mounting side of said facing panels further comprises a first panel mounting clip attached to the top portion of the mounting side and a second panel mounting clip attached to the bottom portion of the mounting side.

4. The panel assembly as recited in claim 1, wherein each of said plurality of support brackets further comprises top support brackets, bottom support brackets and intermediate support brackets.

5. The panel assembly as recited in claim 4, wherein said top support brackets are adapted to be attached to the top portion of said facing panels, said bottom support brackets are adapted to be attached to the bottom portion of said facing panels, and said intermediate support brackets are adapted to be attached to the top portion of one of said facing panels and to the bottom portion of another of said facing panels.

6. The panel assembly as recited in claim 5, further comprising a pair of bottom facing panels, each of said bottom facing panels secured to at least two of the plurality of vertical frame members so that a box beam structure is fabricated to form the rigid frame assembly.

7. The panel assembly as recited in claim 6, wherein said bottom support brackets are also adapted to be mechanically secured to said bottom facing panels.

8. The panel assembly as recited in claim 5, wherein said intermediate support brackets further comprise an upper facing panel attachment member adapted to be pivotally attached to the top portion of the one of said facing panels and a lower facing panel attachment member adapted to be frictionally attached to the bottom portion of the other of said facing panels.

9. The panel assembly as recited in claim 1, wherein said plurality of facing panels are removably mounted to said rigid frame assembly.

10. The panel assembly as recited in claim 1, wherein the rigid frame assembly further comprises base members for supporting the panel assembly in a freestanding manner.

11. The panel assembly as recited in claim 1, wherein a plurality of individual facing panel members are mounted between the crown member and said bottom facing panels such that a first horizontal joint exists between one of said individual facing panel members and one of said bottom facing panels and a second horizontal joint exists between another of said individual facing panel members and the crown member.

12. The panel assembly as recited in claim 11, further comprising a third horizontal joint between said one individual facing panel member and said another individual facing panel member, whereby said horizontal joints provide a passageway for cabling.

13. A panel assembly for a modular office furniture system, the panel assembly comprising:

a rigid frame assembly;

a facing panel assembly;

means for mounting the facing panel assembly to the rigid frame assembly whereby an unobstructed cavity is formed between the rigid frame assembly and the facing panel assembly; and a crown member having means for supporting office furniture accessories thereon attached to a top portion of the rigid frame assembly, wherein said supporting means of the crown member comprises an upper angled clamping surface, a lower angled clamping surface and an inclined mounting surface therebetween such that the lower angled clamping surface is generally spaced apart from the rigid frame assembly.

14. The panel assembly as recited in claim 13, wherein the mounting bracket comprises an upmount bracket.

* * * * *